US010081215B2

(12) United States Patent
Lee

(10) Patent No.: US 10,081,215 B2
(45) Date of Patent: Sep. 25, 2018

(54) COMPACT BALLPOINT PEN

(71) Applicant: Moon Key Lee, Seoul (KR)

(72) Inventor: Moon Key Lee, Seoul (KR)

( * ) Notice: Subject to any disclaimer, the term of this patent is extended or adjusted under 35 U.S.C. 154(b) by 91 days.

(21) Appl. No.: 14/917,606

(22) PCT Filed: Sep. 12, 2014

(86) PCT No.: PCT/KR2014/008546
§ 371 (c)(1),
(2) Date: Mar. 9, 2016

(87) PCT Pub. No.: WO2015/037951
PCT Pub. Date: Mar. 19, 2015

(65) Prior Publication Data

US 2016/0221382 A1 Aug. 4, 2016

(30) Foreign Application Priority Data

Sep. 13, 2013 (KR) ..... 10-2013-0110746
Apr. 15, 2014 (KR) ..... 10-2014-0045104

(51) Int. Cl.
*B43K 7/00* (2006.01)
*B43K 24/08* (2006.01)
*B43K 7/12* (2006.01)

(52) U.S. Cl.
CPC ..... *B43K 7/005* (2013.01); *B43K 7/12* (2013.01); *B43K 24/08* (2013.01)

(58) Field of Classification Search
CPC combination set(s) only.
See application file for complete search history.

(56) References Cited

U.S. PATENT DOCUMENTS 2,928,373 A * 3/1960 Esterow ..... B43K 24/08 401/105
3,196,839 A * 7/1965 Bertoglio ..... B43K 24/086 401/108
3,409,380 A * 11/1968 Longarzo ..... B43K 24/08 401/112
8,434,957 B2 * 5/2013 Kageyama ..... B43K 7/00 401/109

FOREIGN PATENT DOCUMENTS

| | | | |
|---|---|---|---|
| CN | 203004636 | U | 6/2013 |
| JP | 05-049386 | U | 6/1993 |
| JP | H07-012063 | Y2 | 3/1995 |
| JP | 2003-312189 | A | 11/2003 |
| JP | 2013-99967 | A | 5/2013 |
| KR | 20-1999-0008272 | U | 2/1999 |
| KR | 2003-0083845 | A | 11/2003 |
| KR | 20-0382372 | Y1 | 4/2005 |
| KR | 10-1047589 | B1 | 7/2011 |

OTHER PUBLICATIONS

International Bureau, International Search Report in International Application No. PCT/KR2014/008546, dated Dec. 4, 2014.

* cited by examiner

*Primary Examiner* — David Walczak
(74) *Attorney, Agent, or Firm* — Leydig, Voit & Mayer

(57) ABSTRACT

A compact ballpoint pen in which a bar of a push button is split into left and right bars and thus an ink cartridge can be inserted into a space between the split bars. Thus, the length of a ballpoint pen is reduced.

16 Claims, 6 Drawing Sheets

[Fig. 1]
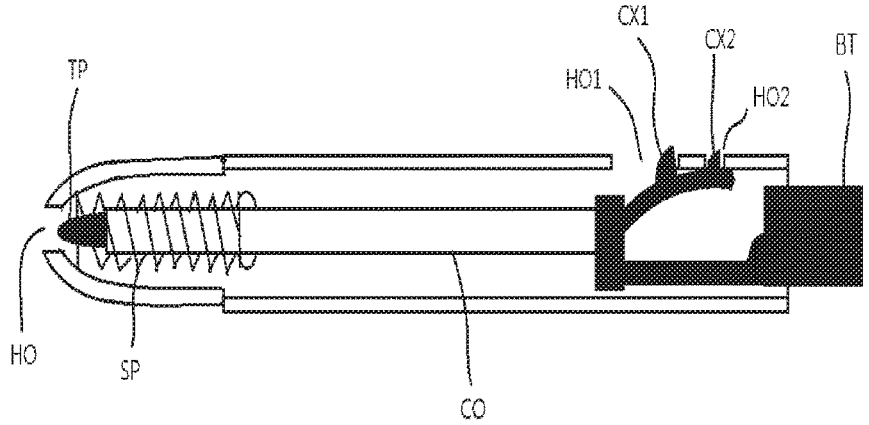
[Fig. 2]
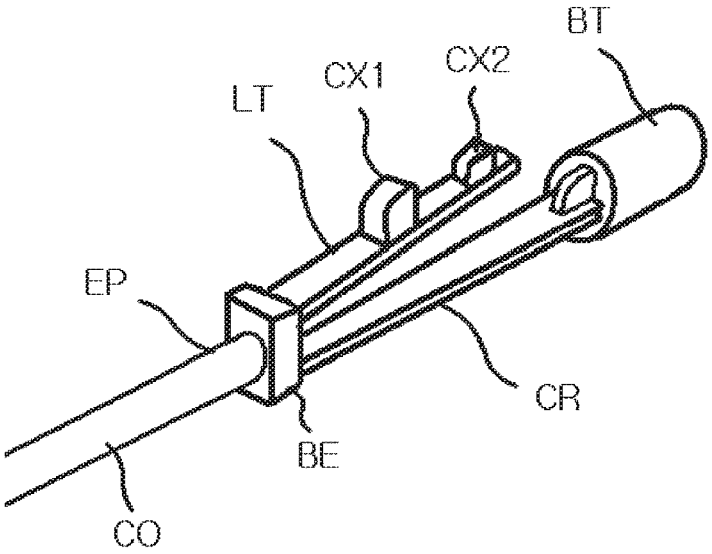
[Fig. 3]
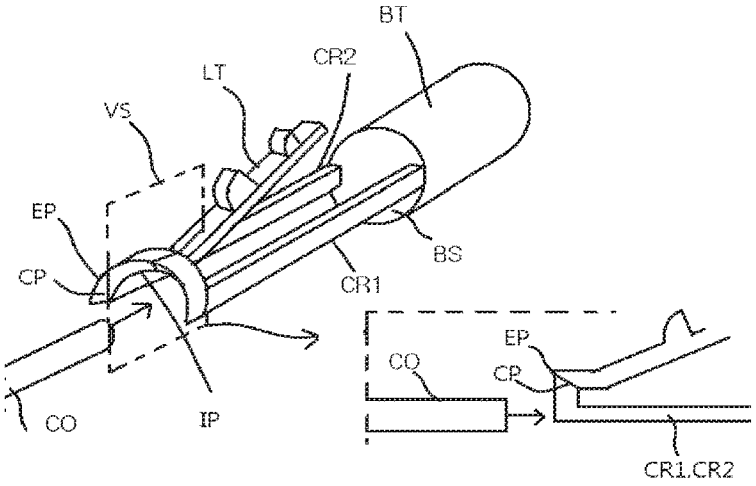

[Fig. 4]
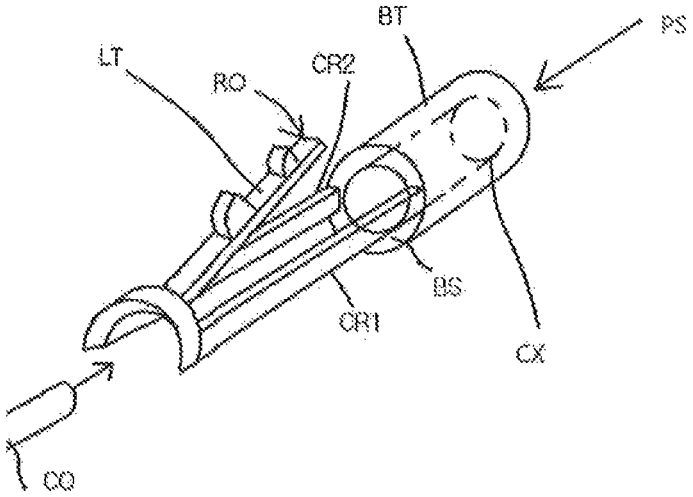
Fig. 5a
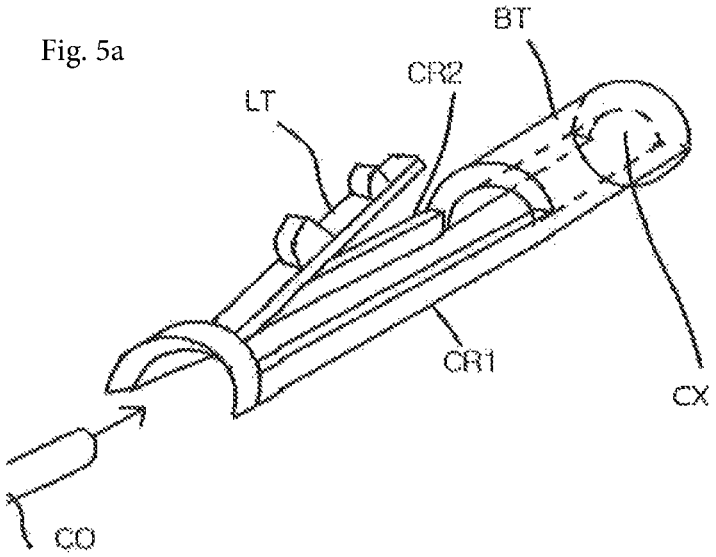
Fig. 5b
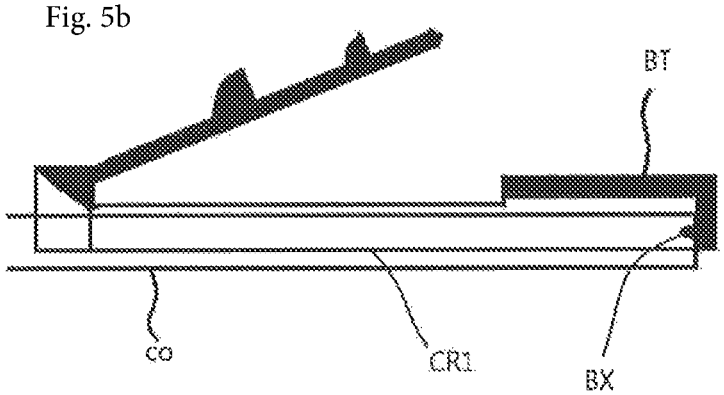

[Fig. 6a]
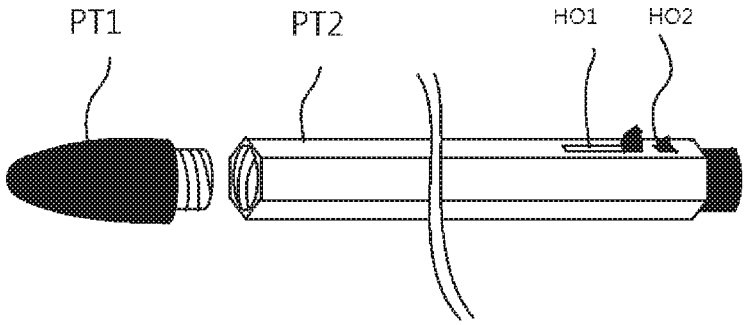
[Fig. 6b]
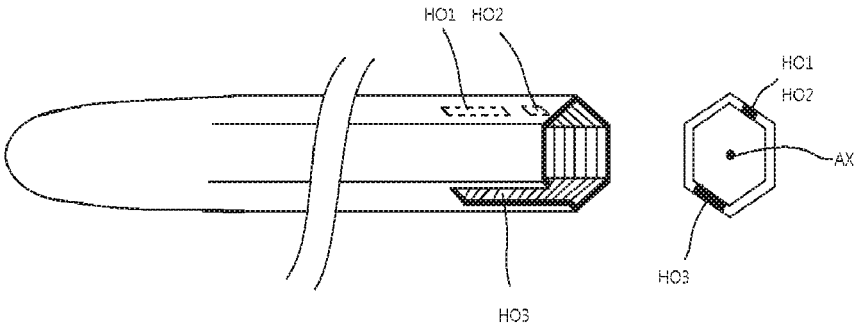
[Fig. 6c]
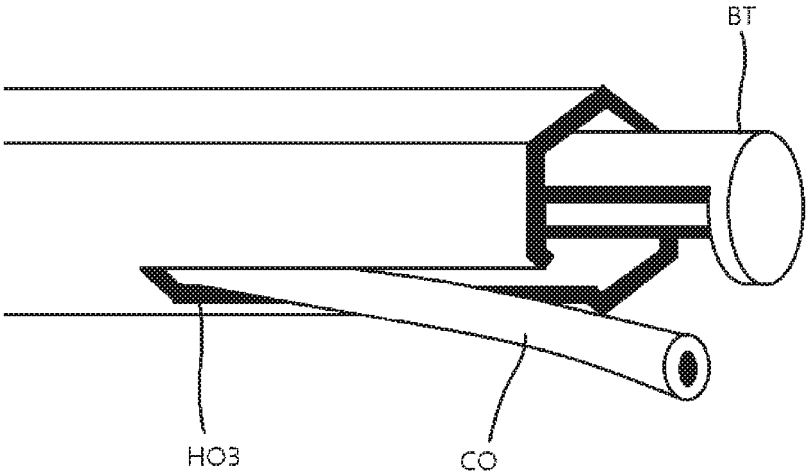

[Fig. 7]
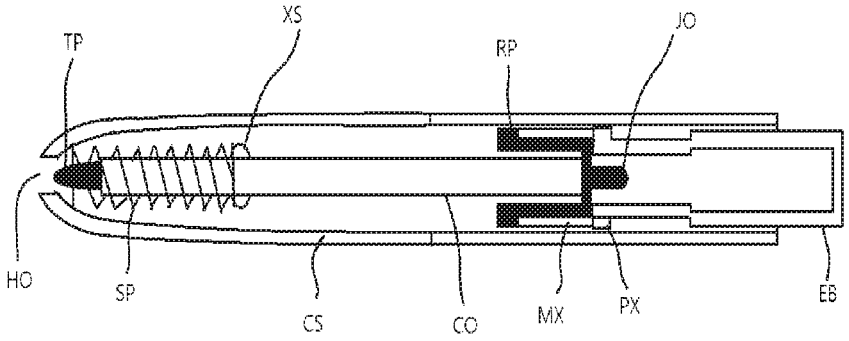
[Fig. 8]
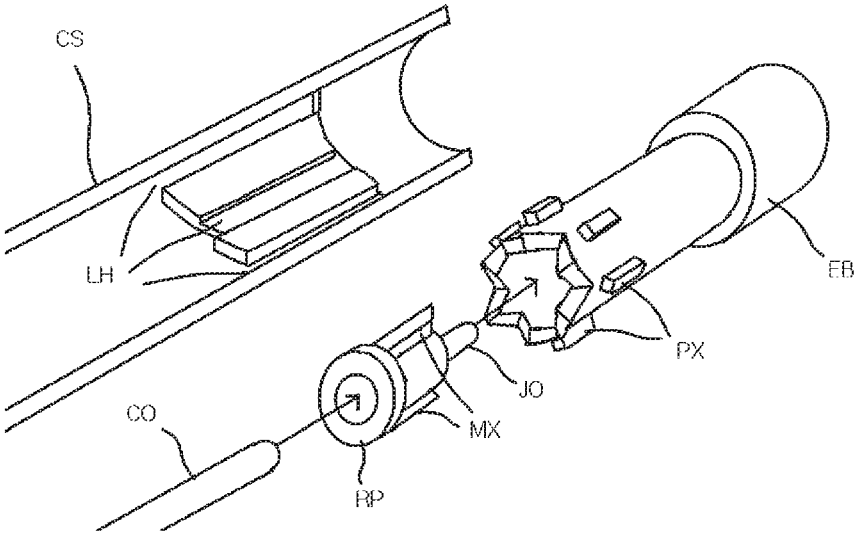
[Fig. 9]
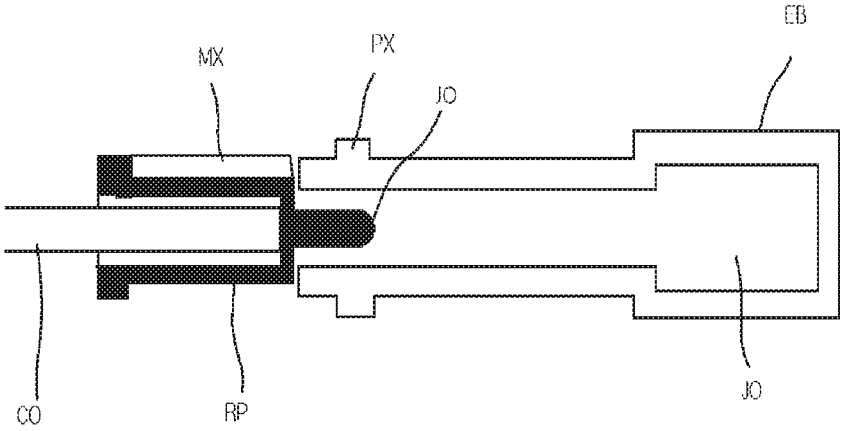

[Fig. 10]
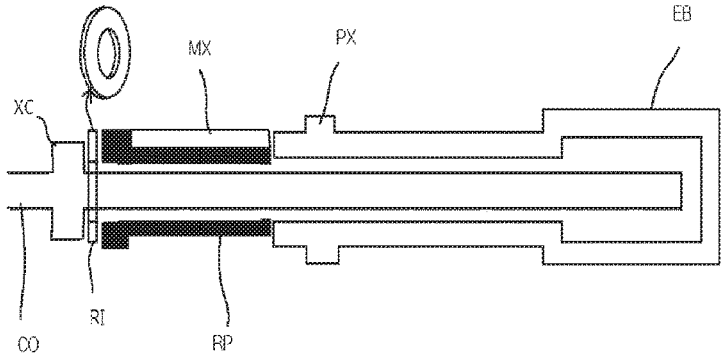
[Fig. 11]
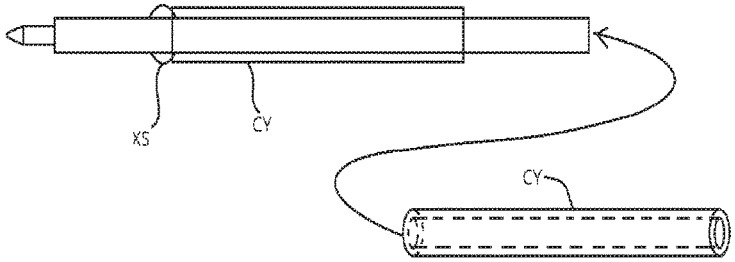
[Fig. 12]
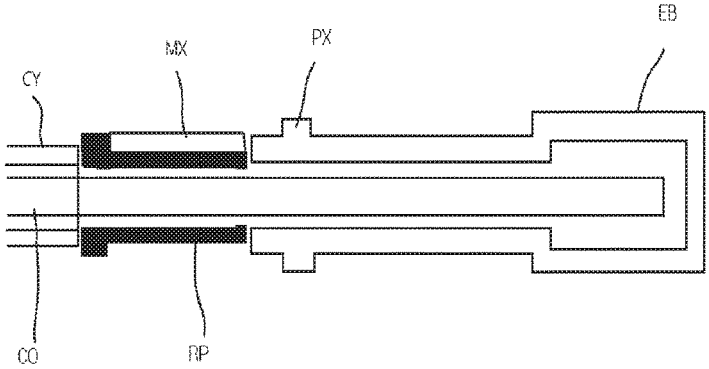
[Fig. 13]
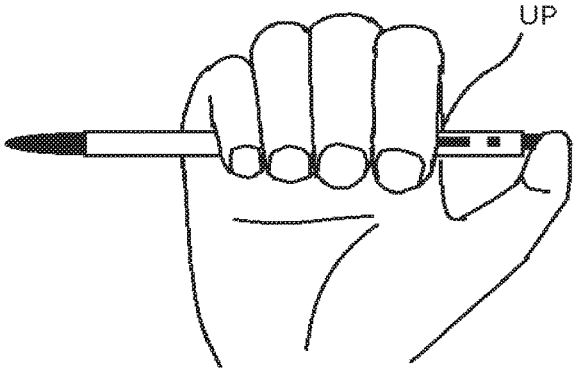
Prior Art

[Fig. 14]
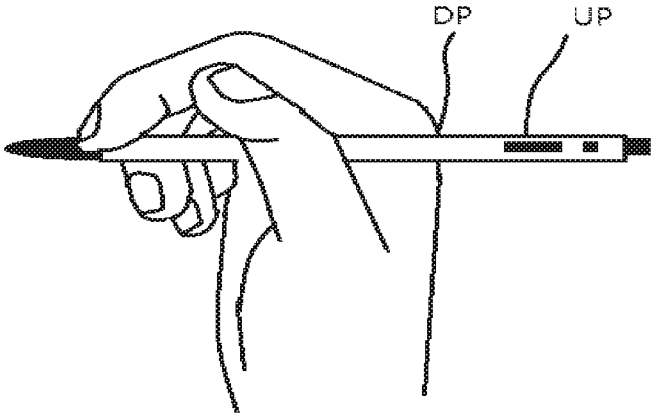
Prior Art
[Fig. 15]
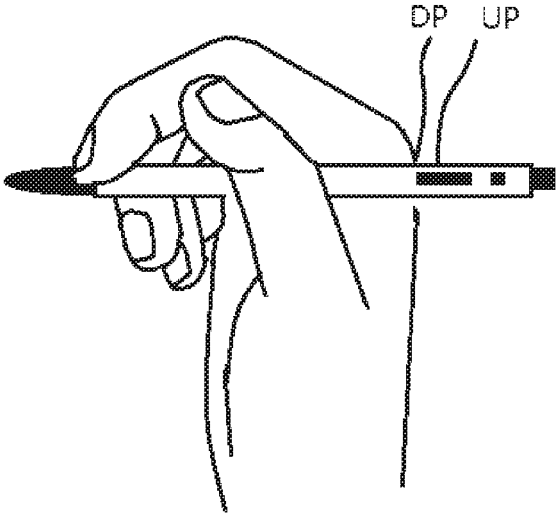

COMPACT BALLPOINT PEN

TECHNICAL FIELD

The present invention relates to a compact ballpoint pen which may be easily put into a small pocket to be conveniently carried.

BACKGROUND ART

FIG. 13 illustrates a position UP of a hand when a thumb pushes a button of conventional long ballpoint pen. FIG. 14 illustrates a position DP of the hand to write with the ballpoint pen, where the hand is moved to a nib side that is the opposite side of the button. In general, it is difficult to take a long ballpoint pen out of a pocket because the long ballpoint pen is easily trapped when being put into a hip pocket of blue jeans or an inside pocket of a jacket.

Further, in order to use a conventional ballpoint pen, a user has to grasp the ballpoint pen and move a thumb to push a button to take a nib out of a case of the ballpoint pen, and inconveniently move a hand to a ball nib side from a button side to write.

DETAILED DESCRIPTION OF THE INVENTION

Technical Problem

The objective of the present invention is to solve a problem that it is difficult to take a long ballpoint pen out of a pocket because the long ballpoint pen is easily trapped when being put into in a hip pocket of blue jeans or an inside pocket of a jacket.

Another objective of the present invention is to solve a problem that, in order to use a conventional ballpoint pen, a user has to grasp the ballpoint pen and move a thumb to push a button to take a nib out of a case of the ballpoint pen, and inconveniently move a hand to a ball nib side from a button side to write.

Technical Solution

According to an aspect of the present invention, there is provided a compact ballpoint pen having a size reduced by modifying a push button of a conventional ballpoint pen so that an ink cartridge of the ballpoint pen may be inserted into a modified push button.

Advantageous Effects

The manufacturing costs of a compact ballpoint pen of the present invention may be reduced because the ballpoint pen of the present invention is smaller than a conventional ballpoint pen and the compact ballpoint pen requires a small amount of materials compared to the conventional ballpoint pen. Also, a use of the compact ballpoint pen may induce less fatigue to write a long document with the compact ballpoint pen of the present invention because the compact ballpoint pen of the present invention is lighter than the conventional ballpoint pen.

Furthermore, a writing speed using a compact ballpoint pen of the present invention may be increased because the compact ballpoint pen has a relatively small inertial moment due to its short length.

Furthermore, the compact ballpoint pen of the present invention is so small that a user may start writing immediately after pushing a button to take a nib out of a case using a thumb while holding the ballpoint pen, and it is unnecessary to move a hand from a button side to a nib side of the compact ballpoint pen.

Especially, kids who have small hands may write more efficiently and quickly because a movement distance of the hand may be reduced by using the compact ballpoint pen of the present invention.

DESCRIPTION OF THE DRAWINGS

FIG. 1 is a cross-sectional view of a conventional ballpoint pen.

FIG. 2 is a perspective view of a structure of the conventional ballpoint pen.

FIG. 3 is a perspective view of a structure of an embodiment of the present invention.

FIG. 4 is a perspective view of a modified example of FIG. 3.

FIG. 5A is a perspective view of a modified example of FIG. 3.

FIG. 5B is a cross-sectional view of FIG. 5*a*.

FIG. 6A is a perspective view of a structure of the conventional ballpoint pen.

FIG. 6B illustrates a ballpoint pen case formed in a single part.

FIG. 6C illustrates a state in which an ink cartridge is inserted into the ballpoint pen case formed in a single part.

FIG. 7 is a cross-sectional view of another conventional ballpoint pen.

FIG. 8 is an exploded view of a structure of a button of FIG. 7.

FIG. 9 is a cross-sectional view of the structure of FIG. 8.

FIG. 10 illustrates a structure of another embodiment of the present invention.

FIG. 11 illustrates a modified example of the embodiment of FIG. 10.

FIG. 12 is a cross-sectional view of FIG. 11.

FIG. 13 illustrates a state of pressing a button of the conventional ballpoint pen.

FIG. 14 illustrates a state of writing with the conventional ballpoint pen.

FIG. 15 illustrates a state of writing with a compact ballpoint pen of the present invention.

BEST MODE

Embodiment 1

FIG. 1 is a cross-sectional view of a conventional ballpoint pen (Monami 153 ballpoint pen), and FIG. 2 is a magnified view of a button. In FIG. 2, an end point EP of a ballpoint pen ink cartridge CO, which is opposite to a nib TP of the ballpoint pen ink cartridge CO, is in contact with a bottom end BE of a push button having a V shape. A first bar and a second bar CR are attached to the bottom end BE of the V-shaped push button. The first bar includes an elastic latch LT formed thereon and the second bar includes a cylindrical cap BT attached thereto. The latch LT includes a first protruding part CX1 and a second protruding part CX2 having a fan shape. The protruding parts are respectively inserted into two holes HO1 and HO2 formed in a ballpoint pen case (a pipe-shaped body of the ballpoint pen). If the cylindrical cap BT is pushed into the ballpoint pen case then the nib TP of the ballpoint pen ink cartridge of the ballpoint pen comes out of a hole HO of the ballpoint pen case. If the first protruding part CX1 is pushed, then the nib TP retreats into the hole HO due to a spring SP inserted in the ballpoint pen.

FIG. 3 illustrates a push button of a ballpoint pen according to an embodiment of the present invention. The difference between the push button of FIG. 2 and the push button of FIG. 3 is that the second bar CR is modified into two separated left and right bars CR1 and CR2 so that the ballpoint pen ink cartridge may be inserted into a space corresponding to a position of the second bar CR of FIG. 2. The two separated left and right bars CR1 and CR2 may be located as close to a surface of the ballpoint pen case as possible so that the ballpoint pen ink cartridge may be inserted into the space corresponding to a position of the second bar CR. Being located close to the surface of the ballpoint pen case means being located far from a center axis of the ballpoint pen case having a pipe shape. One of the two separated left and right bars CR1 and CR2 may be omitted. The ballpoint pen ink cartridge CO, which is inserted between the two bars CR1 and CR2, contacts a bottom surface BS of the cylindrical cap BT of the push button.

As the ballpoint pen ink cartridge CO is inserted into the space between the two bars CR1 and CR2, as described above, a total length (a distance from the nib TP to the cylindrical cap BT of the push button) of the ballpoint pen of FIG. 3 is shorter as long as the second bar CR than the length of the ballpoint pen of FIG. 1.

In order to facilitate insertion of the ballpoint pen ink cartridge between the two bars CR1 and CR2, the end point EP of the push button of FIG. 3 is sharp and an inner surface CP of the end point EP is slanted like a funnel.

FIG. 4 illustrates that a cylindrical groove CX is formed in the cylindrical cap BT of the push button of FIG. 3 so that the ballpoint pen ink cartridge may be inserted into the groove CX. Since a button BT having the above structure enables the ballpoint pen ink cartridge to be inserted to the end of the button BT, a total length of the ballpoint pen may be reduced compared with the case of FIG. 3. As illustrated in FIG. 4, if a user pushes the cylindrical cap BT of the push button, then the latch LT is moved in a direction PS in which the cylindrical cap BT is pushed and is pressed (RO) by the case and the ballpoint pen ink cartridge CO under the latch LT is forced to move downwardly (the opposite side of the latch LT). In this case, in order to smoothly push down the latch LT, it is necessary for the ballpoint pen ink cartridge to be located as low as possible (toward the opposite side of the latch). To this end, a lower half part of the cylindrical cap BT of the push button may be removed as illustrated in FIG. 5A.

If the lower half part of the cylindrical cap BT is not removed, then the radius of a pipe of the ballpoint pen case increases. As a result, such a structure may prevent an increase in the volume of the ballpoint pen case and accordingly, costs of materials may be reduced. Also, the costs of transport may be reduced by decreasing the weight of the ballpoint pen.

FIG. 5B is a cross-sectional view of a state in which the ballpoint pen ink cartridge is inserted into the ballpoint pen button in the structure of FIG. 5A.

As illustrated in FIG. 6A, the conventional ballpoint pen (Monami 153 ballpoint is pen) includes two parts PT1 and PT2 which may be disassembled by rotating the nib side part PT1 so that the ballpoint pen ink cartridge may be replaced. As illustrated in FIG. 6B, the two parts may be formed into a single part and a concave passage HO3 having a U shape may be formed in the case so that the ballpoint pen ink cartridge may be exchanged. By making the ballpoint pen case with the single part, a manufacturing process may be simplified and the shape of a cross-section of the case may be freely selected. Also, the possibility of loss of disassembled parts may be reduced.

A screw thread is formed on each of the conventional two parts PT1 and PT2 so that the parts PT1 and PT2 may be assembled by being screw-coupled to each other. The screw thread is formed on a cylindrical surface so as to be assembled by being rotated. In other words, a cross-sectional view of an assemble region of the two parts should be cylindrical. However, the single part of the present embodiment has no limit in shape so that the case may be designed in any cross-sectional shape. The case having an arbitrary shape may be designed directly by a user and may be manufactured by a three-dimensional printer.

The concave passage HO3 may be formed at the opposite side of the holes HO1 and HO2. In this regard, the opposite side means that the holes HO1 and HO2 and the concave passage HO3 are formed at opposite sides with respect to a center axis AX of a cylindrical case. As illustrated in FIG. 5B, a protrusion BX to be inserted into the ballpoint pen ink cartridge may be formed on an inner surface of the cylindrical cap BT of the push button according to the present embodiment, thereby preventing the ballpoint pen ink cartridge from escaping out of the case through the concave passage HO3 during writing. FIG. 6C illustrates that the ballpoint pen ink cartridge is loaded through the concave passage HO3.

Embodiment 2

Among existing ballpoint pens, there are products in which a nib of a ballpoint pen protrudes out of a case when a button is pressed once and the nib retreats into the case when the same button is pressed again. FIG. 7 is a cross-sectional view of the ballpoint pen described above. FIG. 8 illustrates a structure of the button of the ballpoint pen. In FIG. 8, concave grooves LH are formed in an inner surface of a ballpoint pen case CS so that convex portions PX and MX of a push button may be inserted into the is concave grooves LH. FIG. 8 is a cross-sectional view of the ballpoint pen case CS cut by a plane passing an axis of the ballpoint pen case CS. The push button includes an upper push portion EB and an inner rotating portion RP which is inserted into a lower side of the upper push portion EB. The upper push portion EB is exposed to the outside so as to be pushed by a hand. A ballpoint pen ink cartridge CO is inserted into the inner rotating portion RP. A surface where the upper push portion EB and the inner rotating portion RP contact each other is formed unevenly like a sawtooth.

FIG. 9 is a cross-sectional view of the structure of FIG. 8. If the upper push portion EB is pushed, then the inner rotating portion RP is pushed down, rotated, and latched by an inner surface of the ballpoint pen case CS so that the nib TP comes out of the hole HO. If the upper push portion EB is pushed again, then the inner rotating portion RP is pushed down and rotated so that the nib TP retreats into the hole HO.

FIG. 10 illustrates a modified example of the button of FIG. 9. In FIG. 10, a second convex portion XC is formed at the opposite side of the nib TP of the ballpoint pen ink cartridge CO. A first convex portion XS is formed close to a nib portion, as illustrated in FIG. 11, so that a spring is inserted. The second convex portion XC may be manufactured in the same way as the first convex portion XS that fixes the position of the spring inserted into ink cartridge. The second convex portion XC is touched to the inner rotating portion RP by an expansion force of the spring. A hole is formed in the inner rotating portion RP so that the ballpoint pen ink cartridge may pass through the hole. Accordingly, the opposite end of the nib TP of the ballpoint pen ink cartridge may reach an end portion of the upper push portion EB. Such a structure has a problem that the second convex portion XC of the ballpoint pen ink cartridge CO may be easily worn out by friction with the inner rotating portion RP that rotates. In order to prevent the wearing down of the second convex portion XC, a ring RI or a washer formed of a material, for example, metal, exhibiting superior endurance against the wearing down may be additionally inserted between the second convex portion XC of the ballpoint pen ink cartridge and the inner rotating portion RP.

As illustrated in FIG. 11, instead of newly forming the second convex portion XC on the ballpoint pen ink cartridge, a long pipe CY may be inserted around the ballpoint pen ink cartridge and stopped by the first convex portion XS for inserting the spring at the nib portion. FIG. 12 illustrates a cross-sectional view of a ballpoint pen with the long is pipe CY inserted around the ballpoint pen ink cartridge and stopped by the inner rotating portion RP.

Meanwhile, FIG. 15 illustrates that a distance between the two positions UP and DP in the case of the compact ballpoint pen is very short. In other words, in the case of the compact ballpoint pen of the present invention, a user may immediately start writing right after pushing the button with a thumb while holding the ballpoint pen. However, in the case of the conventional long ballpoint pen, in order to write, the whole hand needs to move to the nib side from the button side after pushing the button with the thumb.

Furthermore, the compact ballpoint pen of the present invention is so small that the button is not likely to be pushed by mistake even when the ballpoint pen is kept in a pocket. Accordingly, there is a low possibility that clothes may be stained with ink.

The invention claimed is:

1. A compact ballpoint pen including a button, the button comprising a first bar having a latch protrusion formed thereon and a second bar having a cap attached on one end thereof and the first bar and the second bar being coupled to each other in a V form, in which an ink cartridge comes out of a case hole when the cap is pushed and the ballpoint pen ink cartridge retreats into the case hole when the latch protrusion is pushed, wherein the first bar and the second bar are arranged close to a surface of a ballpoint pen case, forming an empty space, through which an end portion of the ballpoint pen ink cartridge, opposite to a nib of the ballpoint pen ink cartridge, reaches the cap, wherein a concave passage is formed at an opposite side to another one or more case holes formed in the ballpoint pen case, into which the latch protrusion is inserted, the ballpoint pen ink cartridge being loaded or released through the concave passage.

2. The compact ballpoint pen of claim 1, wherein a section of a portion where the first bar and the second bar meet has a slanted funnel shape to facilitate insertion of the ballpoint pen ink cartridge.

3. The compact ballpoint pen of claim 1, wherein the inside of the cap has an empty space into which the end portion of the ballpoint pen ink cartridge, opposite to the nib of the ballpoint pen ink cartridge, is inserted.

4. The compact ballpoint pen of claim 3, wherein a lower part of the cap at an opposite side to the first bar is removed.

5. The compact ballpoint pen of claim 1, wherein a protrusion to be inserted into the ballpoint pen ink cartridge is formed on an inner surface of the cap.

6. The compact ballpoint pen of claim 1, wherein the second bar comprises two bars that are formed at the left and right sides of a plane on which the first bar moves when the latch protrusion of the first bar is pushed.

7. The compact ballpoint pen of claim 6, wherein a section of a portion where the first bar and the second bar meet has a slant funnel shape to facilitate insertion of the ballpoint pen ink cartridge.

8. The compact ballpoint pen of claim 6, wherein the inside of the cap has an empty space into which one end portion of the ballpoint pen ink cartridge, opposite to the nib of the ballpoint pen ink cartridge, is inserted.

9. The compact ballpoint pen of claim 8, wherein a lower part of the cap at an opposite side to the first bar is removed.

10. The compact ballpoint pen of claim 6, wherein a protrusion to be inserted into the ballpoint pen ink cartridge is formed on an inner surface of the cap.

11. A compact ballpoint pen including a button, the button comprising a first bar having a latch protrusion formed thereon and a second bar having a cap attached on one end thereof and the first bar and the second bar being coupled to each other in a V form, in which an ink cartridge comes out of a case hole when the cap is pushed and the ballpoint pen ink cartridge retreats into the case hole when the latch protrusion is pushed, wherein the first bar and the second bar are arranged close to a surface of a ballpoint pen case, forming an empty space, through which an end portion of the ballpoint pen ink cartridge, opposite to a nib of the ballpoint pen ink cartridge, reaches the cap, wherein the second bar comprises two bars that are formed at the left and right sides of a plane on which the first bar moves when the latch protrusion of the first bar is pushed.

12. The compact ballpoint pen of claim 11, wherein a section of a portion where the first bar and the second bar meet has a slant funnel shape to facilitate insertion of the ballpoint pen ink cartridge.

13. The compact ballpoint pen of claim 11, wherein the inside of the cap has an empty space into which the end portion of the ballpoint pen ink cartridge, opposite to the nib of the ballpoint pen ink cartridge, is inserted.

14. The compact ballpoint pen of claim 13, wherein a lower part of the cap at an opposite side to the first bar is removed.

15. The compact ballpoint pen of claim 14, wherein a concave passage is formed at an opposite side to another one or more case holes formed in the ballpoint pen case, into which the latch protrusion is inserted, the ballpoint pen ink cartridge being loaded or released through the concave passage.

16. The compact ballpoint pen of claim 11, wherein a protrusion to be inserted into the ballpoint pen ink cartridge is formed on an inner surface of the cap.

* * * * *